US005582565A

United States Patent [19]

Soria

[11] Patent Number: 5,582,565

[45] Date of Patent: Dec. 10, 1996

[54] TRICEPS EXERCISE APPARATUS

[76] Inventor: Michael A. Soria, 2613 Union St., Lake Station, Ind. 46405

[21] Appl. No.: 345,831

[22] Filed: Nov. 28, 1994

[51] Int. Cl.[6] ..... A63B 23/12

[52] U.S. Cl. ..... 482/141; 482/38; 482/96; 482/908

[58] Field of Search ..... 482/95, 96, 141, 482/142, 145, 34, 106, 139, 143, 148, 38, 908

[56] References Cited

U.S. PATENT DOCUMENTS

| | | | |
|---|---|---|---|
| 4,360,198 | 11/1982 | Waulters | 482/139 |
| 4,858,917 | 8/1989 | Montgomery | 482/106 |
| 4,923,194 | 5/1990 | Montgomery | 482/141 |
| 5,106,079 | 4/1992 | Escobedo et al. | 482/141 |
| 5,190,513 | 3/1993 | Habing et al. | 482/142 |
| 5,226,868 | 7/1993 | Montgomery | 482/141 |
| 5,230,684 | 7/1993 | Wallisch | 482/141 |
| 5,330,408 | 7/1994 | Westmoreland, Jr. | 482/141 |

FOREIGN PATENT DOCUMENTS

| | | | |
|---|---|---|---|
| 3211826 | 10/1983 | Germany | 482/142 |

*Primary Examiner*—Lynne A. Reichard
*Assistant Examiner*—Victor K. Hwang
*Attorney, Agent, or Firm*—Richard G. Kinney

[57] ABSTRACT

A triceps exercise apparatus wherein a pair of adjacent hand grips angled upward at about 30 degrees and sized to receive the user's hands in an overhand grip are formed from a generally horizontal bar whose height is approximately 19½ inches above the level of the user's feet. The device allows a user to grip the bar with his or her arms above his or her head and his or her body facing downward and extended to one side of the bar at an approximate right angle. The apparatus includes a block for receiving the feet of the user and means for manually adjusting the distance of the block from the bar so as to adjust the apparatus to users of differing heights. The bar is adjustable in height relative to the level of the blocks in the first embodiment by a pair of manually adjustable telescoping standards which support the bar at its longitudinal ends and in the second embodiment by a central standard that is manually pivotable to adjust the bar.

5 Claims, 5 Drawing Sheets

TRICEPS EXERCISE APPARATUS

FIELD OF THE INVENTION

The present invention is directed to new and improved exercise apparatus and especially such apparatus which is intended to aid in the development of the user's triceps.

BACKGROUND OF THE INVENTION

In physical training, especially physical training of boxers, the development of the triceps is difficult to achieve. Triceps development helps determine the shock or power of a boxer's punch. Conventional weight and exercise machines do not adequately target the development of the triceps of their users for boxing.

SUMMARY OF THE INVENTION

A triceps exercise device for use by a human and allowing the user to extend his body generally facing downward with the tips or balls of his feet touching the ground and with his arms over his head and his hands in an overhand grip at a fixed height above the feet such that the user can raise and lower his or her body from a position wherein his or her hands are below his or her head to a position above his or her grip and thus exercise his or her triceps.

The invention, together with further advantages and features thereof, may best be understood by reference to the following description, taken in connection with the accompanying drawings, in the several figures of which like reference numerals identify like elements.

DETAILED DESCRIPTION

Figure 1:
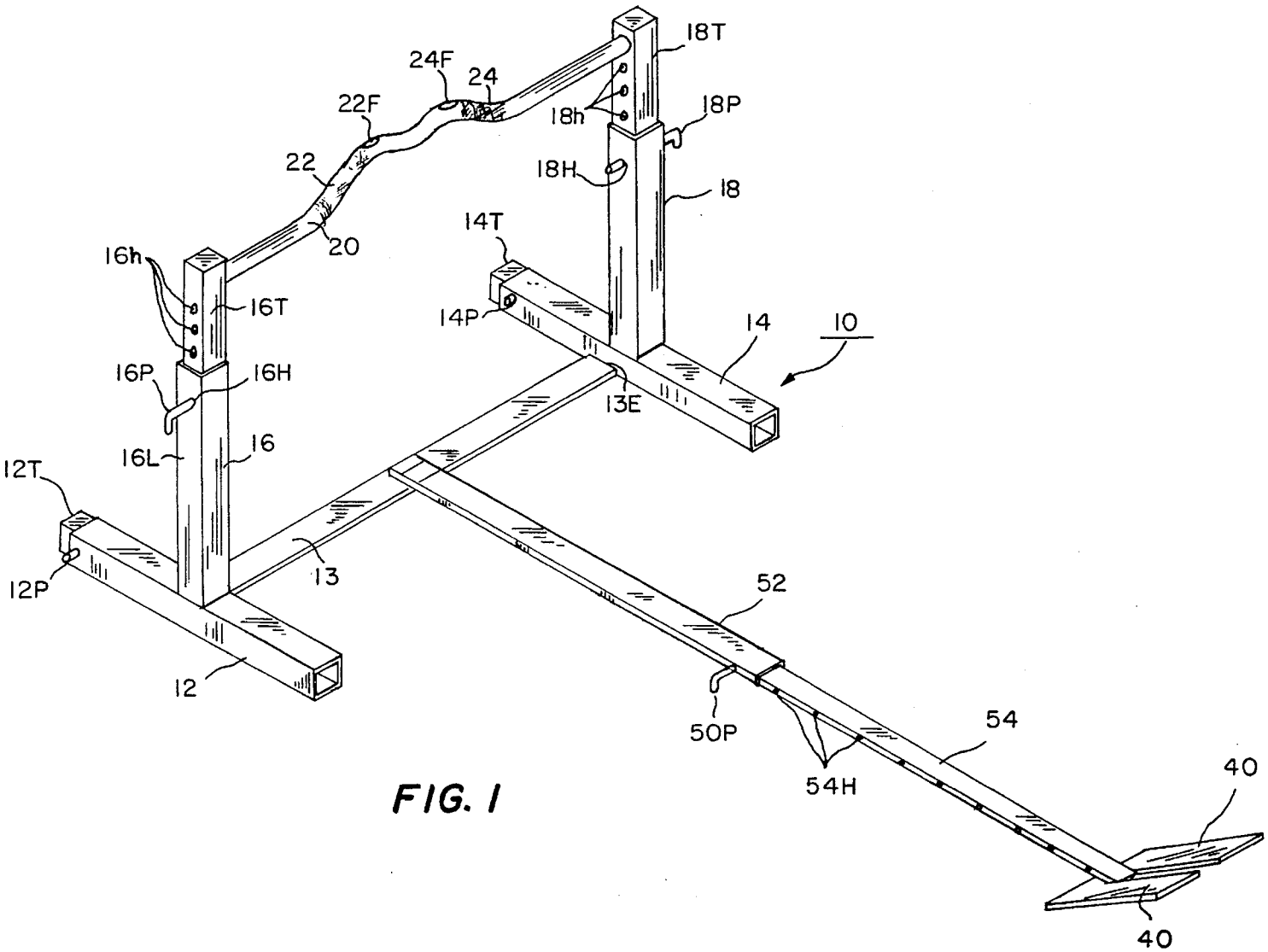
FIG. 1 is a perspective view of a triceps exercise apparatus made in accordance with the principles of the present invention.
Figure 2:
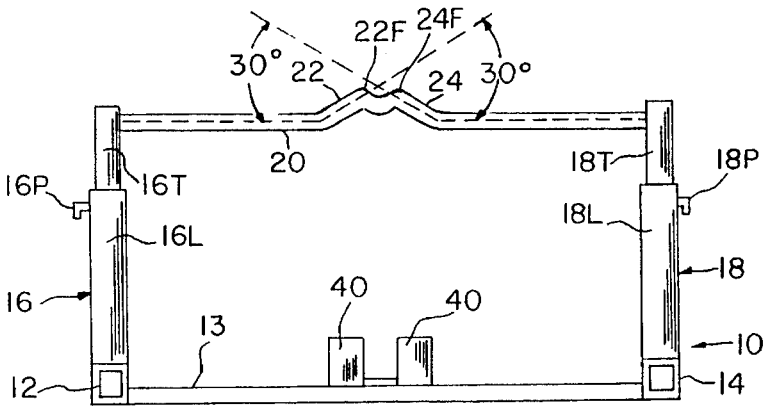
FIG. 2 is an end view of the apparatus of FIG. 1.
Figure 4:
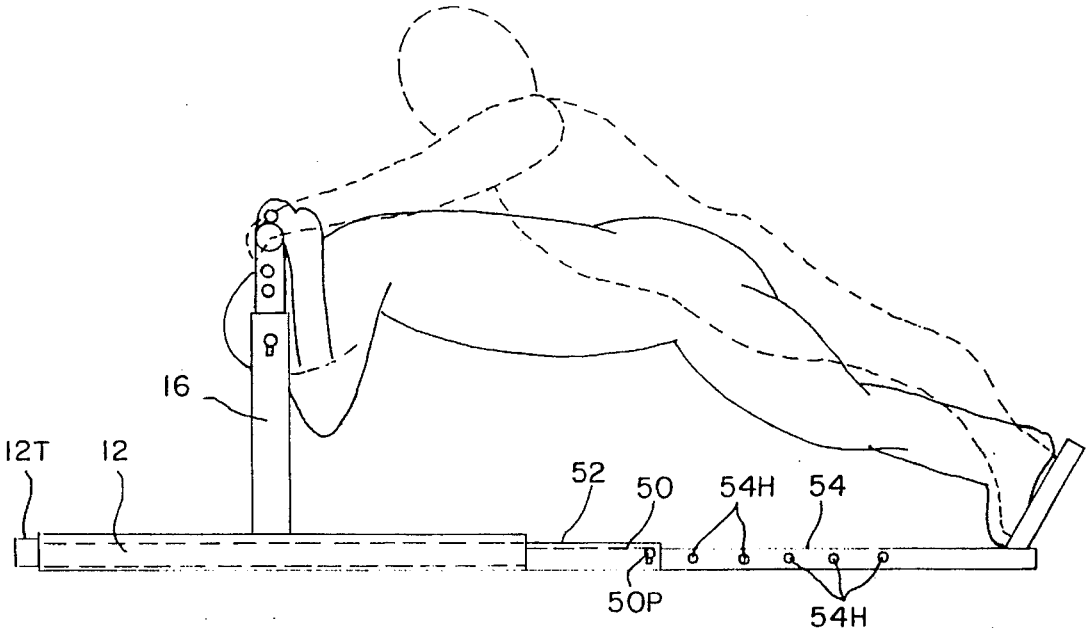
FIG. 4 is a side view of the apparatus of FIGS. 1–4 with a user indicated in solid lines and in a moved position in dashed lines.
Figure 5:
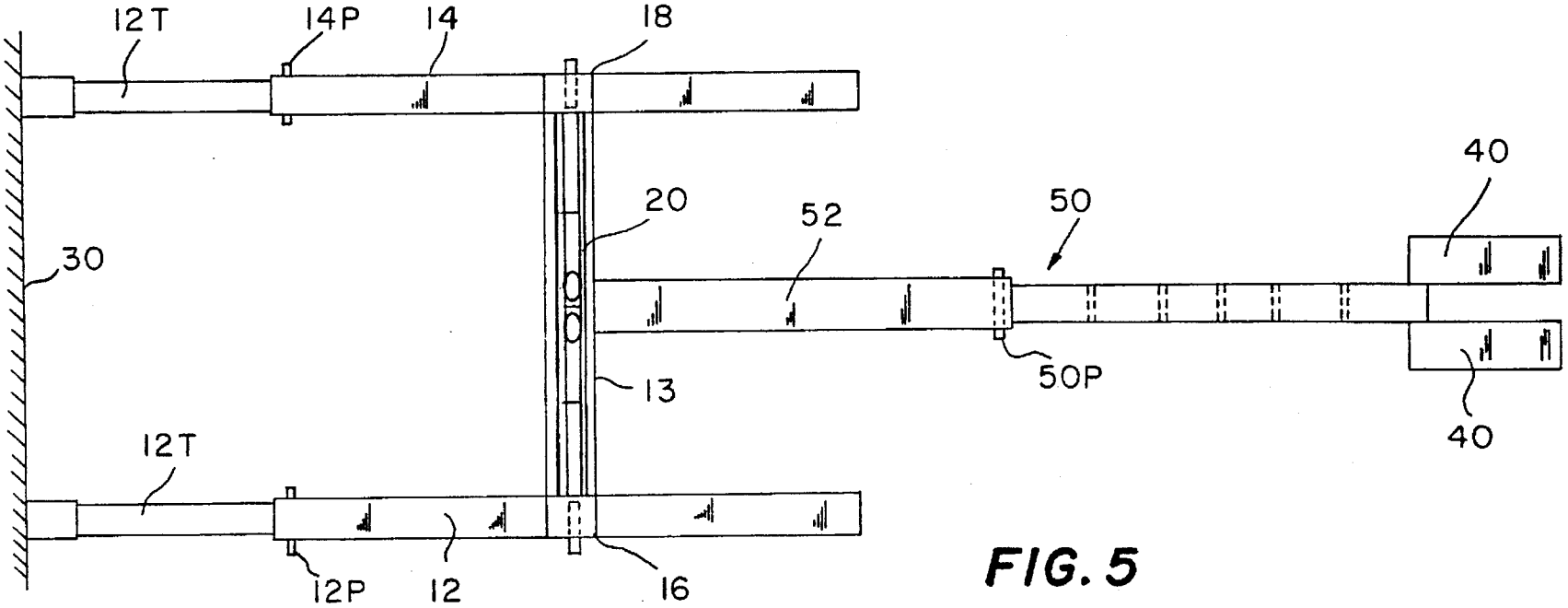
FIG. 5 is a top view of the embodiment of FIGS. 1–4 with certain parts shown in a moved position.

Referring to FIGS. 1, 2 and 4, there is depicted a triceps exercise apparatus constructed in accordance with the principles of the present invention and generally designated by the number 10. The apparatus 10 includes a left elongated base member 12 and a right elongated base member 14 which are preferably made of generally square cross-section tubular steel and are arranged in a parallel but spread apart array and connected together by a central cross bar 13 welded at its ends 13E to the sides of the members 12 and 14. Thus, as best shown in FIGS. 1 and 5, the members 12, 13 and 14 form a general H shape.

At the center of members 12 and 14 are welded vertical standards 16 and 18 which are preferably adjustable in height by being formed of a lower square cross section tube 16L and 18L welded at one end to the tubes 12 and 14 respectively and open at the other end to receive in a telescoping manner a smaller sized tubular top member 16T and 18T. The lower members 16L and 18L each have a pair of aligned horizontal holes such as the holes 16H, 18H which receive a pin 16P, 18P. The members 16T, 18T each have a plurality of corresponding holes 16h and 18h spaced along their length which are alignable with the holes in the receiving member and through which the pins 16P, 18P may pass. Thus, by removing the pins 16P, 18P, the height of the members 16T and 18T can be adjusted and, by placing the pins in different ones of the holes 16h, 18h, the height of the standards 16 and 18 changed.

A grip bar 20 is secured at either end to the top of one of the members 16T and 18T. The grip bar 20 is preferably welded or otherwise secured to the member 16T, 18T so as to not turn therein.

Figure 3:
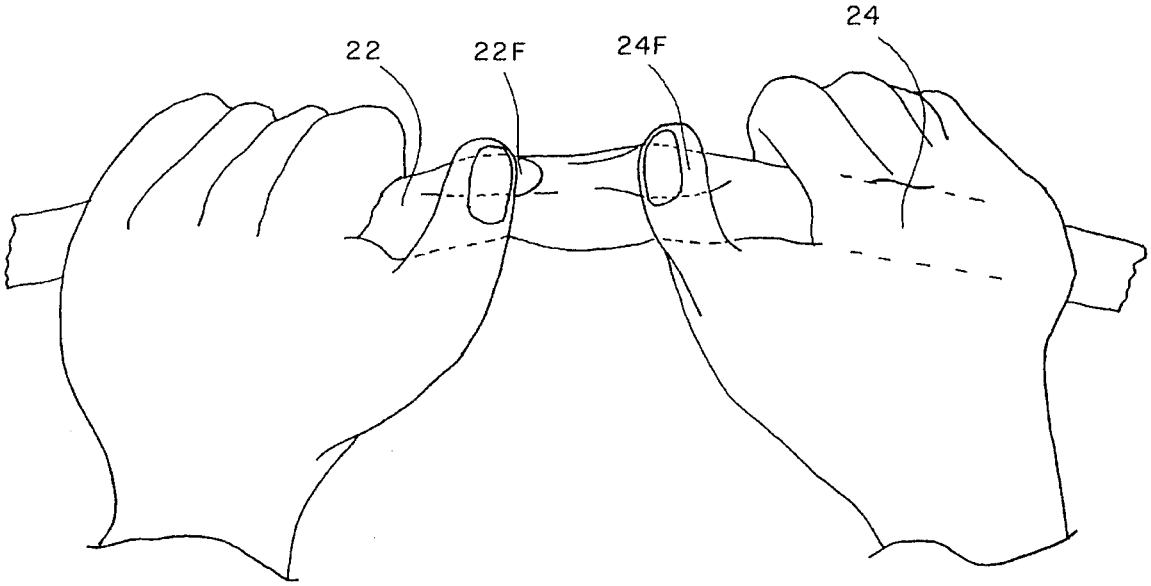
FIG. 3 is a perspective top view on an enlarged scale indicating the grip of the user on the apparatus of FIGS. 1 and 2.

In accordance with a principle of the present invention, the grip bar 20 is formed with a left hand grip 22 and a right hand grip 24 which are slanted upward at approximately 30 degrees. At the inside and elevated end of the grips 22 and 24 are flats 22F and 24F sized and shaped to receive the thumbs of a user and to aid him or her in aligning his or her hands on the grip bar as shown in FIG. 3. By receiving the thumbs in this manner, the user targets the triceps and effectively eliminates additional stress to the forearm.

The apparatus 10 also preferably has a telescoping base member 12T and 14T held in a similar manner by pins 12P, 14P. These can, as shown in FIG. 4, be extended and pinned in place and serve best to position the apparatus 10 against a wall such as the wall 30 in FIG. 5 as well as to spread the weight and frame of the apparatus and user over a larger area. (Similar extensions can be enlarged on the other ends of the members 12 and 14.)

The apparatus 10 preferably also includes a pair of foot blocks 40 for receiving the feet of a user as shown in FIG. 2. The blocks 40 are preferably welded or similarly secured to an adjustable length member 50 which may consist of a rectangular tube 52 welded at one of its ends to the center of the cross member 13 and has its other end open to receive a rectangular bar 54 which has the foot blocks 40 welded at one end and has its other end received in a telescoping manner into the tubular member 52. A pin 50P and aligned holes in the member 52 serve to secure the member 54 in any of a number of positions (determined by corresponding holes 54H) so as to adjust the position of the blocks 40 to better fit users of different heights. Although the apparatus is preferred to be used with blocks 40 and bar 50, these may be dispensed with and the user simply position his feet on the floor as appropriate for his height.

In use, the user grips the grips 22, 24 with an overhand grip as shown in FIG. 3 and assumes a position such as that shown in solid lines in FIG. 4 and then lowers his head and body to the position of approximately dashed lines as shown in FIG. 4. By repeated cycling between these positions (as in the manner of performing push-ups), the user exercises and develops his triceps. Note that the bar 20 and grips 22, 24 and their mounting provide no obstacle or impediment to the users head moving between the positions shown in FIG. 4.

Figure 6:
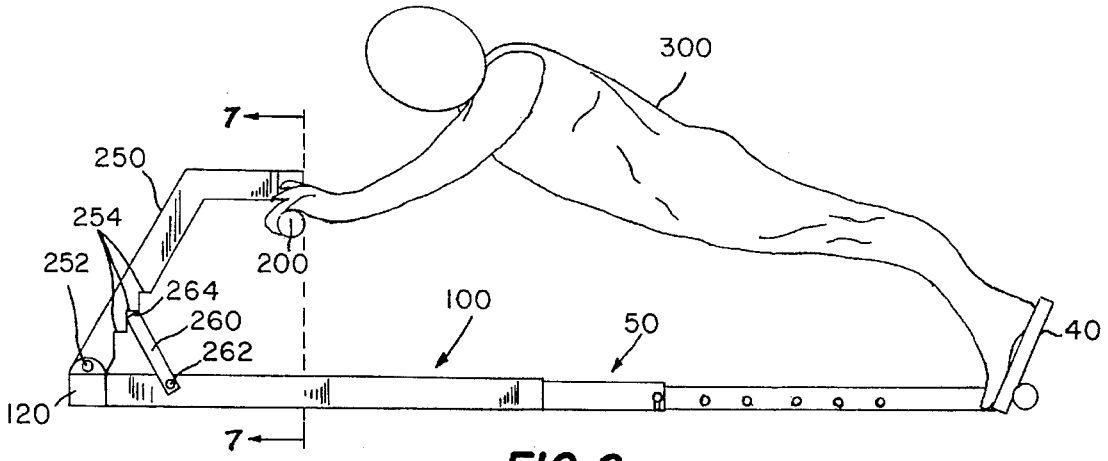
FIG. 6 is a side view of a second embodiment of a triceps exercise apparatus constructed in accordance with the principles of the present invention with a user shown thereon.
Figure 7:
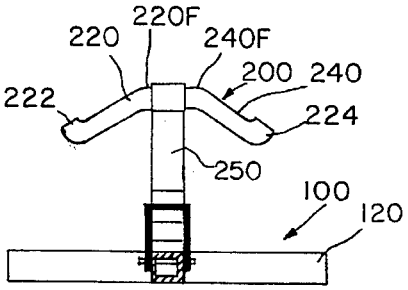
FIG. 7 is a sectional view of the apparatus of FIG. 6 as seen from the plane of the line 7—7 of FIG. 6 when looking in the direction of the arrows.
Figure 8:
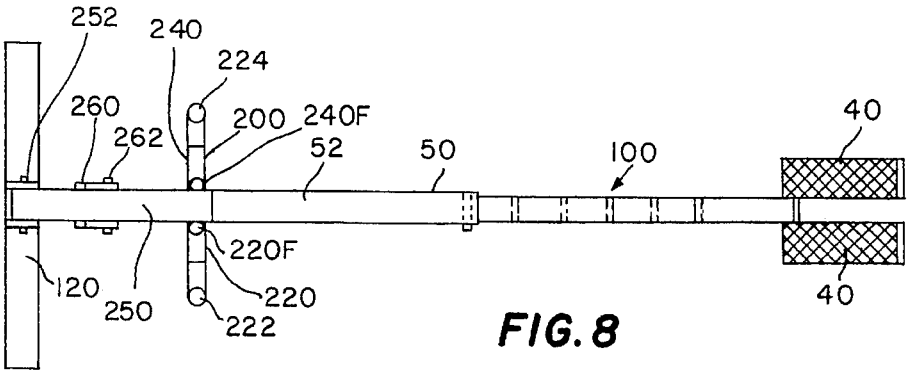
FIG. 8 is a top view of the apparatus of FIGS. 6 and 7.

A second embodiment of the invention is shown in. FIGS. 6, 7 and 8 and generally identified by the number 100. This apparatus 100 has a pedal 40 and assembly 50 identical to that of the first embodiment 10. However, it has a grip bar 200 which has left and right grips 220 and 240 which are substantially like those of the grips 22 and 24 and includes flats 220F and 240F which are substantially similar to the flats 22F and 24F. At the ends of grips 220, 240 are upturned sections 222, 224 which help prevent the user's hands from slipping off the bar 200. The bar 200 is centrally supported on a bracket 250. This bracket 250 is in turn hinged at 252 to a base member 120 which base number 120 is also welded to the member 52 of the assembly 50 to form a T-shaped base as shown best in FIG. 8.

The bracket's 250 height is adjustable by positioning a hinged arm 260 which pivots about joint 262. The top 264 of the arm 260 fits into one or another of several notches 254 in the bracket 250. By moving the arm end 264 from one to another of the notches 254 the height of the grip bar 200 is raised or lowered.

The user, such as the man 300 of FIG. 6, grips the grip bar with both hands in an overhand grip (such as that shown in FIG. 3) and, with his feet in the blocks 40. The user may then exercise his triceps as in the previous embodiment.

It should be noted that in either arrangement the higher the bar the less stress and force is required. Thus, a new user may start with the bar set high and lower it gradually as he or she develops his or her triceps.

It should now be apparent that exercise apparatus of particular use in performing an exercise designed to develop the user's triceps has been disclosed. For purposes of completeness of disclosure, but not to limit the scope of the invention, certain dimensions and materials have been noted above and will be set out here below. A prototype of the invention was constructed using a bar about 1½ inches in diameter and about 48 inches in length similar in shape to that of the bar 22 of the first embodiment. This bar was supported on a framework made up of standards approximately 19¼ inches in height and base member 12 and 14 about 12 inches long.

In the first embodiment, the members 12 and 14 are preferably made of 2 by 2 inch square steel tubing, 3/16 inch in wall thickness, and have a length of 12 inches. The member 13 is preferably a flat steel bar, 3/16 inch by 3 inches, about 31 inches long made of steel tube, with the member 54 having a cross-section 1½ by 1½ inches and holes 54H spaced approximately every one inch so as to adjust the distance from the bar 20 to the feet blocks 40 from approximately 36 inches to 84 inches. The height of the bar 20 is preferably adjustable from 16 inches to 30 inches in steps of one inch.

The second embodiment of FIGS. 6–8 preferably has a base member 120 of 14 inches in length, made of 2 inch by 2 inch steel tubing, with a wall thickness of 3/16 inch. The bracket 250 preferably has an overall length of about 36 inches and is made up of welded square tubing of a size similar to that of the base and member 120. The bar 200 is preferably adjustable in height from approximately 20 inches to 30 inches.

While two particular embodiments of the invention have been shown and described, it will be obvious to those in the art that changes and modifications may be made without departing from the invention and, therefore, the aim in the appended claims is to cover all such changes and modifications as fall within the true spirit and scope of the invention.

I claim:

1. Triceps exercise apparatus for mounting on a flat horizontal surface, comprising a pair of grips, one of said pair of grips provided for the left hand of a user and one of said pair of grips provided forthe right hand of the user, said pair of grips have a top and a lower and higher ends and means for receiving the thumbs of a user are provided at the top of the inside higher ends of each of said pair of grips to effectively eliminate additional stress to the user's forearm, said thumb-receiving means is a flat portion formed on said top of the higher ends of each of said pair of grips, which grips are generally bar shaped and means for mounting said hand grips such that each is angled at an approximately 30 degrees to the horizontal such that when gripped by the left and right hands of a user in an overhand grip, the thumb end is higher than the small finger end of the grip, such means for mounting the grips also mounting said hand grips at approximately the same height and in the same vertical plane at a height above the horizontal surface, and each of said grips is separated by a few inches in a spaced-apart adjacent array said apparatus having no impediment under or aside said pair of grips so that a user who is facing generally downward with his hands gripping the grips and his feet together at a displacement to one side of the grips may exercise his or her triceps by repeatedly lowering his head to between and below his or her arms and below the grips without encountering any impediment and raising his head to above his arms while keeping his hands on the grips and his feet stationary.

2. The apparatus of claim 1 wherein said pair of grips are formed from a single length of bar and said mounting means includes means adjusting the height of the bar.

3. The apparatus of claim 1 wherein feet-receiving means are provided and means for fixing the feet-receiving means relative to said pair of grips is also provided.

4. The apparatus of claim 3 wherein said pair of grips are formed from a single length of bar and said mounting means includes means adjusting the height of the bar.

5. The apparatus of claim 4 wherein said means for fixing the feet-receiving means relative to said pair of grips is manually adjustable so as to fix the distance between said pair of grips and said feet-receiving means at a number of different distances.

* * * * *